United States Patent [19]

Kraess et al.

[11] 4,195,275

[45] Mar. 25, 1980

[54] MULTIPLE ELECTROMAGNETIC RELAY

[75] Inventors: Henri Kraess; Paul Bloch, both of Strasbourg, France

[73] Assignee: Societe Anonyme dite: La Telephonie Industrielle et Commerciale - Telic, Strasbourg, France

[21] Appl. No.: 949,360

[22] Filed: Oct. 6, 1978

[30] Foreign Application Priority Data

Nov. 8, 1977 [FR] France ..... 77 33544

[51] Int. Cl.[2] ..... H01H 1/52; H01H 9/20

[52] U.S. Cl. ..... 335/120; 335/160

[58] Field of Search ..... 335/120, 160, 233; 361/166, 167

[56] References Cited

U.S. PATENT DOCUMENTS

| | | | |
|---|---|---|---|
| 2,292,471 | 8/1942 | Ostline | 335/120 |
| 2,416,970 | 3/1947 | Wassmer | 335/120 |
| 3,106,625 | 10/1963 | Marley | 335/120 |

*Primary Examiner*—Harold Broome

*Attorney, Agent, or Firm*—Sughrue, Rothwell, Mion, Zinn and Macpeak

[57] ABSTRACT

The invention relates to a multiple relay comprising a control relay (9) and a plurality of individual relays (8). The "fixed" contacts of the individual relays (8) are in fact, only semi-stationary and are carried on a common insulator bar (4) which pivots on an axis (5) under the control of the control relay. Each semi-stationary "fixed" contact of an individual relay is connected to a conductor bar (6) (one conductor bar per semi-stationary contact of the relay) carried by the common bar. Electrical contact between a semi-stationary contact and a moving contact is established by energizing the control relay then the individual relay and by de-energizing the control relay and then the individual relay; the semi-stationary contact locks the moving contact. Electrical contact is broken by momentarily energizing the control relay.

7 Claims, 5 Drawing Figures

MULTIPLE ELECTROMAGNETIC RELAY

FIELD OF THE INVENTION

The invention relates to a set of electromagnetic relays and applies to the connection of one or several electric circuits to one or several common circuits which can, for example, be power supply bus bars.

The invention also applies to space switching networks such as are found in telecommunications where, to establish a connection, two bars referred to as vertical bars must be connected to two horizontal bars.

BACKGROUND OF THE INVENTION

It is known to use relays to form connection points between vertical and horizontal bars. It is also known to hold contacts of a relay magnetically to form connection points; magnetic holding is obtained by magnetizing a part made of a material which has high remanence by means of a momentary electric current. To cancel holding at the end of a call, said part must be demagnetized. This is done by making an electric current flow in the opposite direction to the direction necessary for magnetization.

The present invention aims to provide a multiple relay which does not have the disadvantages of requiring a reverse electric current to cancel the magnetic holding.

SUMMARY OF THE INVENTION

The invention provides a multiple electromagnetic relay comprising on a support, a control relay, a plurality of individual relays and a common bar made of insulative material, said common bar being situated above said control relay and above said individual relays and including a conductor bar, said individual relays each having at least one moving contact integral with an armature and one fixed contact connected to said conductor bar, said common bar pivoting about an axis under the control of the control relay, an electrical contact between a moving contact and a fixed contact of one of the individual relays being established by energizing firstly said control relay then said individual relay and then by de-energizing said control relay and then said individual relay, the electrical contact then being held by mechanical locking of the moving contact by the fixed contact, unlocking being obtained and electrical contact being broken by momentarily energizing the control relay.

An embodiment of the invention will be described by way of example with reference to the accompanying drawings:

DESCRIPTION OF THE PREFERRED EMBODIMENT

Figure 1:
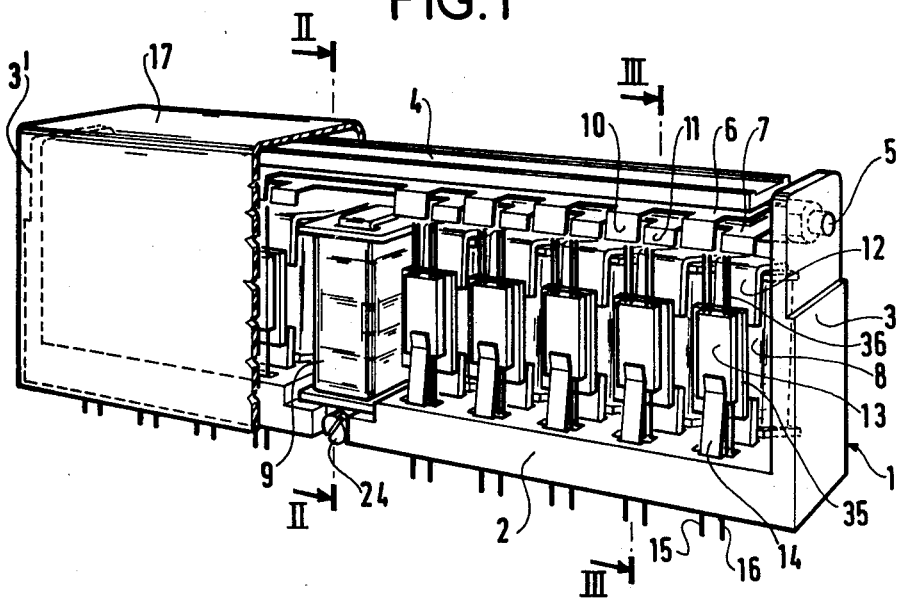
FIG. 1 is a general perspective view partially broken away, of a multiple relay.

FIG. 1 shows a multiple electromagnetic relay: a U-shaped support 1 is constituted by a stand 2 and two arms 3 and 3'. A common locking control relay 9 and a plurality of relays 8 are fixed to the stand; a common insulator bar 4 pivots on an axle 5 received in the arms 3 and 3'; the common bar 4 is situated above the control relay 9 and above the individual relays 8 and supports, along its whole length, first and second conductor bars 6 and 7 which have respective folded tabs 10, 11 facing each individual relay.

The tabs 10, 11 have two functions, electrically they serve as "fixed" contacts with respect to the moving contacts of the individual relays 8, and mechanically they also serve as locking members to hold the moving contacts of the individual relays 8 in the operate position. A return spring, (not shown), brings the common bar 4 back to its release position when it has pivoted. Each individual relay 8 comprises a magnetic element 12, a moving component 13, a stop 14 and two terminals 15 and 16, each connected to a respective moving contact which also serves to support the moving component 13. A hood 17 projects the relays as a whole.

Figure 2:
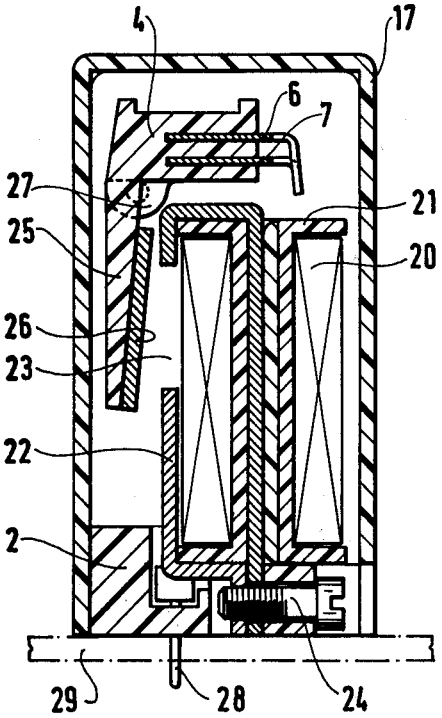
FIG. 2 is a cross-sectional view of the multiple relay of FIG. 1 along line II—II.

FIG. 2 is a cross-section view along the line II—II of the multiple relay; this cross-sectional is through the common locking control relay 9. This shows the stand 2 and the bar 4 common to the conductor bars 6 and 7. The control relay is fixed to the stand 2 by a screw 24 and comprises a winding 20 wound on an insulating former 21, a magnetic circuit element 22 with a gap at 23. At the control relay, the common bar 4 has a flap 25 fitted with an armature 26 made of a magnetic material, facing the gap 23 in the magnetic circuit element. At each of its ends the common bar 4 has a cylindrical part 27 in which the axle 5 is engaged; the common bar can therefore pivot. When the control relay is energized, the armature 26 is attracted and comes against the magnetic circuit 22; this makes the common bar pivot upwards. A pin 28 is connected to one end of the winding 20. The multiple relay is plugged into a printed circuit board 29.

Figure 3:
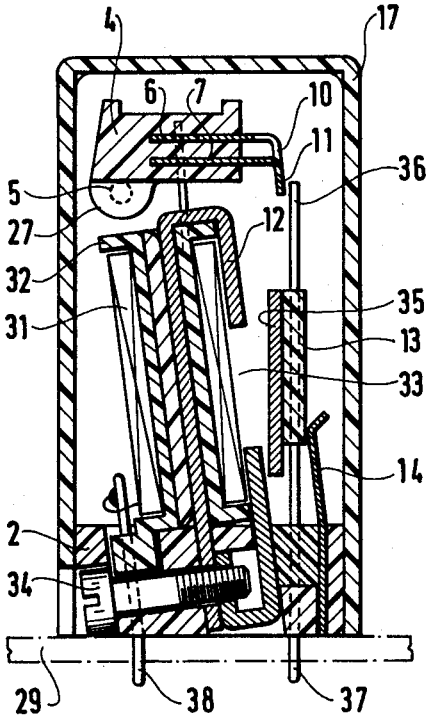
FIG. 3 is a cross-sectional view of the multiple relay of FIG. 1 along line III—III.

FIG. 3 is a cross-sectional view along the line III—III of the multiple relay; this cross-section is through an individual relay 8. This figure again shows the stand 2, the bar 4 common to the conductor bars 6 and 7 and, level with the individual relay, one of the tabs 10 of the first conductor bar 6 and one of the tabs 11 of the second conductor bar 7. The individual relay is fixed to the stand by a screw 34 and comprises a winding 31 wound on an insulating former 32, the magnetic circuit element 12 with a gap at 33 and the moving component 13 is electrically insulative and is provided with an armature 35 made of a magnetic material facing the gap 33 in the magnetic circuit element. Passing through the moving component there are two electrical contacts which will be referred to hereinafter as the moving contacts of the individual relay 8. Only one moving contact 36 is shown in the figure, since the other moving contact is behind as shown in FIG. 1. Each moving contact is double and is constituted for example by two wires as in conventional relays; the moving contact is plugged into the stand 2 and its end constitutes a pin 37. With the common bar in the release position and the control relay de-energized, the upper end of the moving contact comes opposite to a tab 10 for example, the end of the other moving contact coming opposite to a tab 11, each of the tabs 10 and 11 being in electrical contact as has been said with the respective bars 6 and 7.

In the release position, with the individual relay de-energized, the moving component 13 comes against the stop 14 which is, for example, a metal blade plugged into the stand. A pin 38 is connected to one end of the winding 31. The relay is plugged into the printed circuit board 29.

Since the upper end of each moving contact 36 is opposite a tag 10 or 11 in the release position, the common bar 4 must pivot to clear the upper end of the moving contacts before an individual relay is energized to attract the armature 35 and hence the moving component 13.

Figure 4:
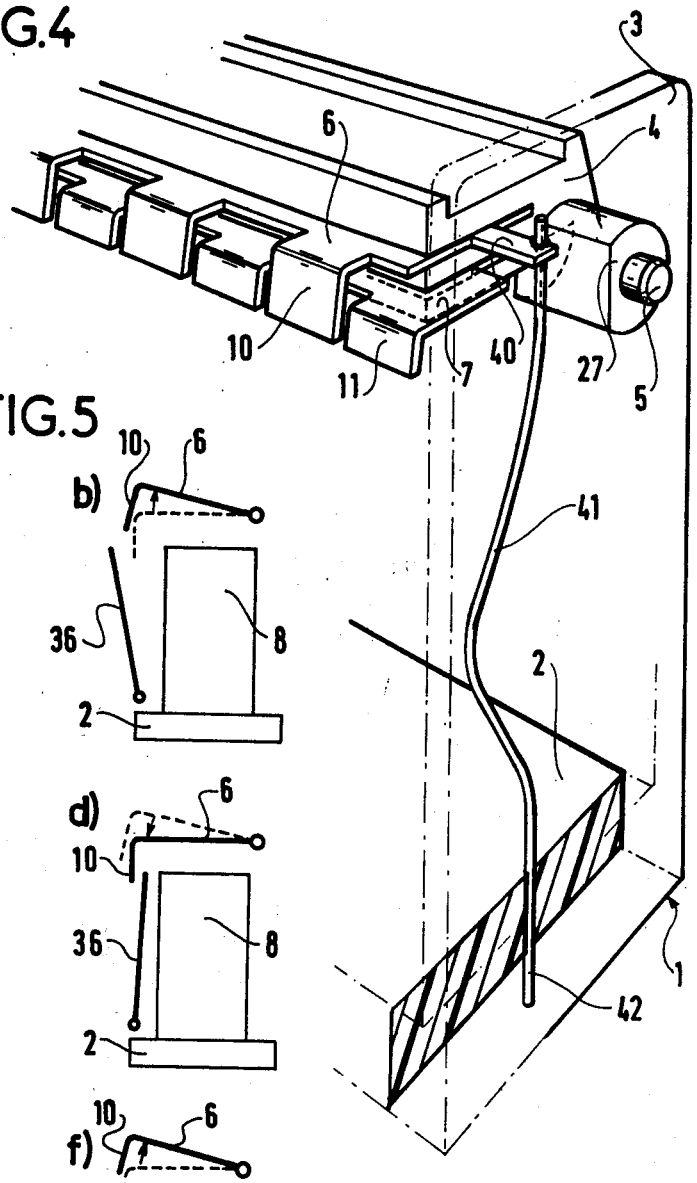
FIG. 4 is a perspective view which shows the power supply connection of a bus bar of the multiple relay.

FIG. 4 shows the supply connection of the first conductor bar 6, by way of example. The bar 6 has a tab 40 fixed to a connection 41 constituted by a metal wire or a metal lamination plugged into the stand 8 and acting as a spring, the end of the connection which extends below the stand constituting a pin 42. When the control relay is energized the common bar 4 pivots upwards; when the control relay is no longer energized the common bar 4 resumes its release position due to the effect of the connection 41 which acts as a return spring; of course, the second the conductor bar 7 also has a connection which acts as a return spring, this connection being preferably situated at the other end of the common bar 4.

Figure 5:
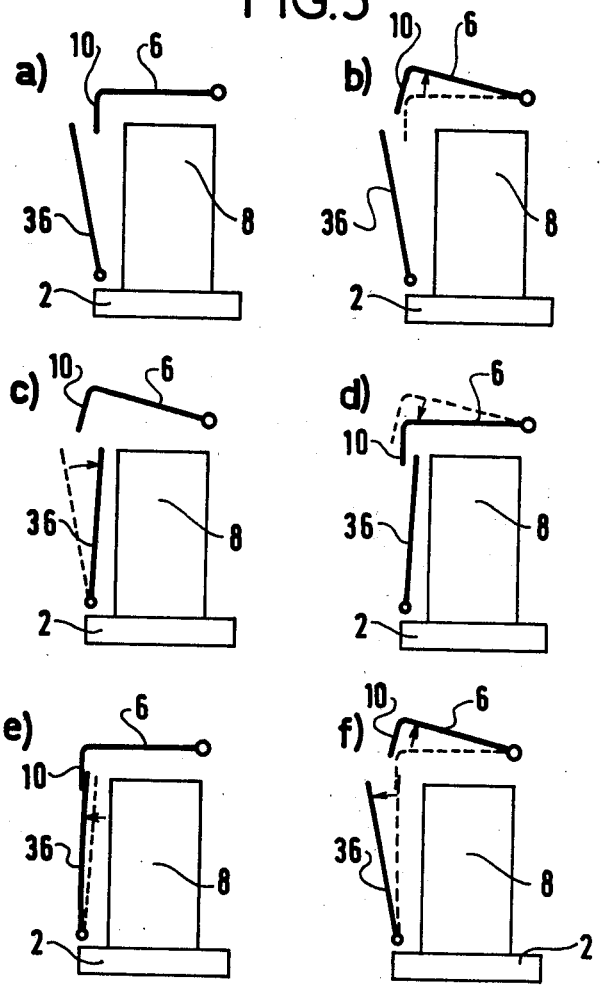
FIG. 5 shows schematically the successive stages in establishing contact of the relay at a, b, c, d and e and also the release of contact at f.

FIG. 5 shows schematically the successive stages a, b, c, d and e of establishing a contact of an individual relay 8 of the multiple relay and of releasing it at f. Although only one tab 10 of the common bar and one moving contact 36 of the individual relay 8 are shown, it must be understood that operation relates to both of the tabs associated with the individual relay 8 and which are integral with the common bar, and to both of the moving contacts which are integral with the moving component 13 of the individual relay 8.

In FIG. 5*a*, the tab 10 is in its low position, (i.e. its release position, since the winding of the control relay is de-energised) and similarly, since the winding of the relay 8 is de-energized, the moving contact 36 is also in the release position.

In FIG. 5*b*, the winding of the control relay is energized, the common bar has pivoted on its axis and the tabs 10 has moved to its high position, thus clearing the upper end of the moving contact 36.

In FIG. 5*c*, while the fixed contact 10 is in the high position, the winding of the individual relay 8 is energized and the moving contact 36 is attracted.

In FIG. 5*d*, the winding of the control relay is de-energized and the tab 10 resumes its release position.

In FIG. 5*e*, the winding of the individual relay 8 is de-energized; since the moving contact 36 is no longer attracted, it moves to resume its release position, but since the tab 10 is already in its release position, the upper end of the moving contact abuts against the tab 10; this establishes the electrical contact between the tab and the moving contacts and mechanially locks said electrical contact which no longer requires either the control relay or the individual relay 8 to be energized to hold it; of course, the moving contact moves only a little way to the locked position—about a few tenths of a millimeter, this corresponding to the distance between the fixed contact and the moving contact in the case of FIG. 5*d*.

FIG. 5*f* shows the release of the electrical contact between the tab 10 and the moving contact 36. The electrical contact is released by energizing the winding of the control relay; the common bar pivots and the tab 10 assumes its high position; the moving contact is therefore released and resumes its release position. The winding of the control relay is then de-energized and the tab 10 resumes its release position; this is then the position illustrated in FIG. 5*a*. Thus no action need be taken by the individual relay 8.

The electrical contact can alternatively be released as follows, as shown in FIG. 5*e*: the winding of the individual relay 8 is energized; this attracts the moving contact 36; this is again the position illustrated in FIG. 5*d*; the winding of the control relay is then energized and the fixed contact 10 assumes the high position, thereby clearing the moving contact 36 as shown in FIG. 5*c*; the winding of the individual relay 8 is de-energized and the moving contact 36 returns to its release position, as shown in FIG. 5*b*, which shows the same position as that illustrated in FIG. 5*f*; the winding of the control relay 10 is then de-energized and the tab 10 returns to its release position, as shown in FIG. 5*a*.

When establishing or releasing the electrical contact, the winding of the individual relay 8 and that of the control relay 10 are energized during the time actually necessary for making or breaking the electrical contact; no current is required to hold the electrical contact.

In the application to a space switching network each of the conductive bars 6 and 7 represents a horizontal bar and each moving contact of a relay is connected to a vertical bar.

To set up a telephone call, two connection points must be established: electrical contact between one of the moving contacts of one of the individual relays and the fixed contact (i.e. tab) of the conductor bar corresponding to the said one of the moving contacts: and electrical contact between the other moving contact of the said relay and the tab of the other conductor bar.

Of course, the invention is in no way limited to the embodiment described and illustrated and without going beyond the scope of the invention, any means can be replaced by an equivalent means.

We claim:

1. A multiple electromagnetic relay comprising on a support, a control relay, a plurality of individual relays and a common bar made of insulative material, said common bar being situated above said control relay and above said individual relays and including a conductor bar, said individual relays each having at least one moving contact integral with an armature and one fixed contact connected to said conductor bar, means for mounting said common bar for pivoting about an axis under the control of the control relay, whereby an electrical circuit is completed between a moving contact and a fixed contact of one of the individual relays and is established by energizing firstly said control relay then said individual relay and then by de-energizing said control relay and then said individual relay, and wherein said relay further comprises means for mechanical locking of the moving contact by the fixed contact, such that unlocking is obtained and the electrical circuit is broken by momentarily energizing the control relay.

2. A multiple relay according to claim 1, wherein each fixed contact of the individual relays is constituted by a folded tab of the conductor bar.

3. A multiple relay according to claim 2, wherein the common bar includes two conductor bars insulated from each other and wherein each individual relay includes two moving contacts and two fixed contacts, each fixed contact being opposite to a moving contact, one of the fixed contacts being connected in operation, to one conductor bar and the other fixed contact being connected to another conductor bar.

4. A multiple relay according to claim 1, further including a return spring to bring the common bar back to its release position after the control relay has been de-energized.

5. A multiple relay according to claim 1, wherein the common bar has a flap fitted with an armature made of magnetic material and located opposite the control relay.

6. A multiple relay according to claim 4, wherein at least one conductor bar is connected to a terminal of the support by a connection which constitutes the return spring for the common bar.

7. A multiple relay according to claim 1, wherein unlocking is obtained and the electrical circuit is broken by energizing a locked individual relay before the control relay is momentarily energized, then by de-energizing said individual relay while the control relay is momentarily energized.

* * * * *